US009822549B2

(12) United States Patent
Gentry et al.

(10) Patent No.: US 9,822,549 B2
(45) Date of Patent: Nov. 21, 2017

(54) PORTABLE FENCE SYSTEM FOR SPORTING EVENTS AND SECURITY APPLICATIONS

(71) Applicant: SPORTAFENCE MARKETING ENTERPRISES, LLC, Sacramento, CA (US)

(72) Inventors: Daniel W. Gentry, Sacramento, CA (US); Gary W. Siewert, Galt, CA (US)

(73) Assignees: SPORTAFENCE, INC., Sacramento, CA (US); SPORTAFENCE MARKETING ENTERPRISES, LLC, Sacramento, CA (US)

( * ) Notice: Subject to any disclaimer, the term of this patent is extended or adjusted under 35 U.S.C. 154(b) by 304 days.

(21) Appl. No.: 14/792,580

(22) Filed: Jul. 6, 2015

(65) Prior Publication Data

US 2017/0009485 A1 Jan. 12, 2017

(51) Int. Cl.
*E04H 17/16* (2006.01)
*E04H 17/18* (2006.01)

(52) U.S. Cl.
CPC ..... *E04H 17/18* (2013.01)

(58) Field of Classification Search
CPC ..... E04H 17/02; E04H 17/16; E04H 17/18; E04B 2/7422; E04B 2/7425; E04B 2/7427; A47G 5/00
USPC ..... 256/1, 24–31, 73; 160/351
See application file for complete search history.

(56) References Cited

U.S. PATENT DOCUMENTS 179,519 A * 7/1876 Cameron ..... A01K 3/00 119/512
4,537,151 A * 8/1985 Bolton ..... A01K 3/00 119/512
5,170,746 A * 12/1992 Roose ..... A01K 3/00 119/512
5,180,143 A 1/1993 Brower
5,213,312 A * 5/1993 MacDonald ..... E01F 13/022 160/351
5,282,606 A * 2/1994 Praiss ..... E04H 4/06 160/135

(Continued)

FOREIGN PATENT DOCUMENTS

GB 2278266 A * 11/1994 ..... A01K 1/0236
WO WO 9918291 A1 * 4/1999 ..... E01F 13/022

(Continued)

*Primary Examiner* — Abigail Troy
*Assistant Examiner* — Nahid Amiri
(74) *Attorney, Agent, or Firm* — R. Michael West

(57) ABSTRACT

A portable fence system comprising a plurality of interlocking fence units. Each fence unit has a main frame and at least one wheel assembly deployable from a withdrawn position to an extended ground-engaging position for rolling. A fence member is pivotally affixed to a forward portion of the main frame. The fence member may be lowered into a horizontal position for storage and raised into a vertical position for use. Downwardly and rearwardly inclined braces extend from a top portion of the fence member to the rear edge of the frame. Protective coverings are placed on portions of the fence member to prevent injuries from impact therewith. Couplers are provided along opposing side portions of the fence member, so that adjacent fence units may be interconnected and arranged to provide the desired length and configuration for the fence system.

20 Claims, 8 Drawing Sheets

(56) References Cited

U.S. PATENT DOCUMENTS 5,402,988 A 4/1995 Eisele
5,718,414 A 2/1998 Deloach
5,799,227 A 7/1998 Elkins
5,899,171 A * 5/1999 Abrahamson ..... A01K 3/00 119/512
6,516,919 B1 * 2/2003 Sempel ..... A01M 31/02 182/187
6,676,113 B2 * 1/2004 Christensen ..... E01F 13/022 160/351
6,805,409 B2 * 10/2004 Parker ..... A47C 9/002 297/158.4
7,172,176 B1 * 2/2007 Eastland ..... E01F 13/022 256/26
7,918,622 B2 * 4/2011 Whitford ..... F41H 5/14 256/13.1
8,226,070 B2 7/2012 Froud
8,528,257 B2 * 9/2013 Kobayashi ..... A01K 1/034 49/463
2009/0032790 A1 * 2/2009 Timms ..... H05C 1/02 256/25
2010/0301295 A1 * 12/2010 West ..... E01F 13/022 256/24
2011/0031458 A1 * 2/2011 Ben Simon ..... E01F 13/022 256/31
2012/0261632 A1 * 10/2012 Bertucat ..... E01F 13/022 256/26
2013/0186038 A1 * 7/2013 Lang ..... E06B 3/481 52/745.16
2015/0075442 A1 * 3/2015 Wilson ..... A01K 3/00 119/512
2015/0207005 A1 * 7/2015 Feng ..... H02S 20/32 136/246
2015/0334987 A1 * 11/2015 Schwartz ..... E04H 17/00 119/514

FOREIGN PATENT DOCUMENTS

WO WO 2013157923 A1 * 10/2013 ..... E01F 13/022
WO WO 2014005581 A2 * 1/2014 ..... E01F 13/022
WO WO 2014153601 A1 * 10/2014 ..... E04H 17/18

* cited by examiner

PORTABLE FENCE SYSTEM FOR SPORTING EVENTS AND SECURITY APPLICATIONS

BACKGROUND OF THE INVENTION

1. Field of the Invention

The invention relates generally to portable fence systems adapted for easy storage when not in use, and quick deployment and assembly, when desired, to define playing fields for sporting events and boundaries for control of crowds at social events. More specifically, the invention pertains to portable fence systems comprising a plurality of serially interconnected fence units, each having one or more deployable wheel assemblies and a pivoted fence member.

2. Description of the Prior Art

U.S. Pat. No. 8,226,070, issued to Froud, discloses a practice fence for tennis and similar games. This construction employs a plurality of mesh panels 18, supported by upright posts 10, which may be permanently secured into the ground. The panels 18 are bolted to the posts 10, to form a substantially planar surface with uniform rebound properties. [See, FIGS. 2 and 4].

A portable sport boundary fence is shown in U.S. Pat. No. 5,180,143, issued to Brower. This fence comprises a plurality of hollow, tubular posts 32, each slidably and removably engaged by a post anchor 40. Perforated netting 50 extends between the plurality of posts to form a continuous fence structure and define the playing field. [See, FIG. 1]. A break-away feature is provided at the base 37 of post 32, and additional support for each post 32 may be provided by stakes 70 and ties 80.

U.S. Pat. No. 5,718,414, granted to Deloach et al., illustrates a lightweight portable fencing system. Included in this system are a plurality of fabric support panels 12 and a plurality of support posts 14. Eyelets 22 are provided along the sides of each panel 12, for engagement by J-shaped hooks 32 protruding from either side of post 14. The lower end of each post includes a large screw 30, for rotatable engagement with the ground.

In U.S. Pat. No. 5,779,227, issued to Elkins et al., a crowd control barrier in the form of a modular fence, is shown. Each fence panel 12 includes a frame 13 which is interiorly spanned by fence fabric 28. A plurality of such panels is interconnected together, in end-to-end fashion, through the use of vertically aligned sleeves (30, 31, 32, 33) and pins (44, 50). Brace members 16 extend orthogonally from the junctures of each panel, and each includes vertically aligned sleeves (42, 43, 48, 49) to mate with the pins interconnecting the panels. The brace members are claimed to maintain the panels in an upright position on substantially any supporting surface, without the necessity of forming post holes or driving posts into the surface of the earth.

In U.S. Pat. No. 5,402,988, granted to Eisele, a portable fence formed from a plurality of sections is taught. The frame 2 of each section is supported by a pair of foot elements 14, which are rotatable about a vertical axis. The foot elements 14 can be rotated outwardly, typically 90° from the plane of the fence, to support the fence, or they can be rotated inwardly into the plane of the section of the portable fence to permit the section to be carried and stored.

However, the need exists for a portable fence unit which can assume a substantially flat configuration for shipment and storage, yet can easily and quickly be deployed into a vertical configuration which can be rolled to a selected location to provide a fence or barrier.

The need also exists for a portable fence system which comprises a plurality of interlocking fence units, each of which includes one or more deployable wheel assemblies allowing the units to be rolled into a desired position, individually or as a string of interlocked units, and then lowered onto the ground for use as a secure and immobile fence or barrier structure.

The need further exists for a portable fence unit which has at least one wheel assembly with a pair of wheels which can be manually rotated from a withdrawn position, above the underside of the frame of the fence unit, to an extended position for engaging the ground and maintaining the underside of the frame of the fence unit in sufficient spaced relation above the ground so it can be rolled to a selected location.

The need further exists for a portable fence unit which has at least one wheel assembly including detachable coupling means for attachment to and removal from the fence unit, facilitating shipment and storage of the fence unit.

These and other objects and features of the invention herein will become apparent from the drawings and the written specification which follow.

SUMMARY OF THE INVENTION

The portable fence system disclosed herein comprises a plurality of interlocking fence units. Each fence unit has a generally horizontal main frame, preferably elongated in configuration, with an elongated rear edge, and lateral sides extending forwardly and perpendicularly therefrom. The lateral sides have forward ends, terminating adjacent the front side of the fence unit.

Each fence unit also includes a fence member with a peripheral frame, preferably rectangular in plan. The peripheral frame includes a top portion, a bottom portion, and side portions defining a barrier area. The bottom portion of the peripheral frame is pivotally affixed to the forward ends of the main frame. The fence member preferably includes chain-link wire or wire netting, within the barrier area of the peripheral frame, to form a physical barrier.

The fence member may be rotated about its pivotal attachment into a lowered horizontal position, overlying the main frame, for shipment and storage. In that lowered position, the fence member and the main frame will present a generally planar surface for compact and stable stacking of successive fence units.

The fence member may also be pivoted upwardly, into a vertical position for use. To ensure its stability and strength as a physical barrier, one or more downwardly and rearwardly inclined braces extends from the top portion of the peripheral frame to the rear edge of the main frame. These braces are rotatably attached to the rear edge of the main frame, so they can be swung up into a raised position, and selectively attached to the top portion of the peripheral frame.

Protective coverings may be placed on portions of the fence member to prevent injuries from impact therewith. These coverings may be sheets of plastic or rubberized material over the chain-link portion, and cylindrical padding material over the top portion of the peripheral frame.

Spanning the rear edge of the main frame and the lower portion of the peripheral frame, is at least one wheel assembly. The wheel assembly includes a support tube, rotatably and removably secured at each end to the main frame and the peripheral frame through the use of detachable coupling means. Attached to the support tube is a pair of spaced wheels. Pivotally attached to the support tube is an arm, which when pivoted into a position perpendicular to the support tube, can readily be swung to rotate the support tube and the attached wheels into a desired rotational position.

The wheel assembly may be rotated into a first withdrawn position. In this position, the wheels are rotated so they lie above the underside of the main frame, allowing the underside of the main frame to lie flat either on the ground or upon another fence unit. With the wheel assembly in the withdrawn position, a plurality of fence units may be horizontally stacked.

The wheel assembly may also be rotated 90°, or so, into a second extended position, to facilitate rolling transport of the fence unit. With the wheel assembly in this deployed position, the main frame is supported in spaced relation from the ground, with sufficient clearance therefrom that the fence unit may be rolled to a selected location. With the fence unit in its final position, the wheel assembly may be rotated back to the first withdrawn position, lowering the main frame of the fence unit onto the ground surface for stable support.

Couplers are provided along opposing vertical side portions of the peripheral frame, so that adjacent fence units may be pivotally interconnected to each other to provide the selected length and configuration for the fence system. An arrangement of vertically offset collars on the opposing side portions of the peripheral frame and linking pipes or pins which register and slide within those collars, has proven a simple, reliable, and sturdy system for connecting fence units together.

This portable fence system expands the versatility of new and existing sports fields by providing a means to reconfigure the playing field for different sports, providing a multi-use facility. This is accomplished by moving, lengthening, shortening, adding, or removing the fence or fences which define the size and configuration of the playing field for a particular sport.

In addition, the portable fence system disclosed herein may also be used for other fence and barrier applications. Byway of example only, such applications would include a dog park, a barrier along a street for crowd control, a fence around a podium or a construction site for security, or a fence used on a ranch to confine animals.

DETAILED DESCRIPTION OF THE PREFERRED EMBODIMENT

Figure 1:
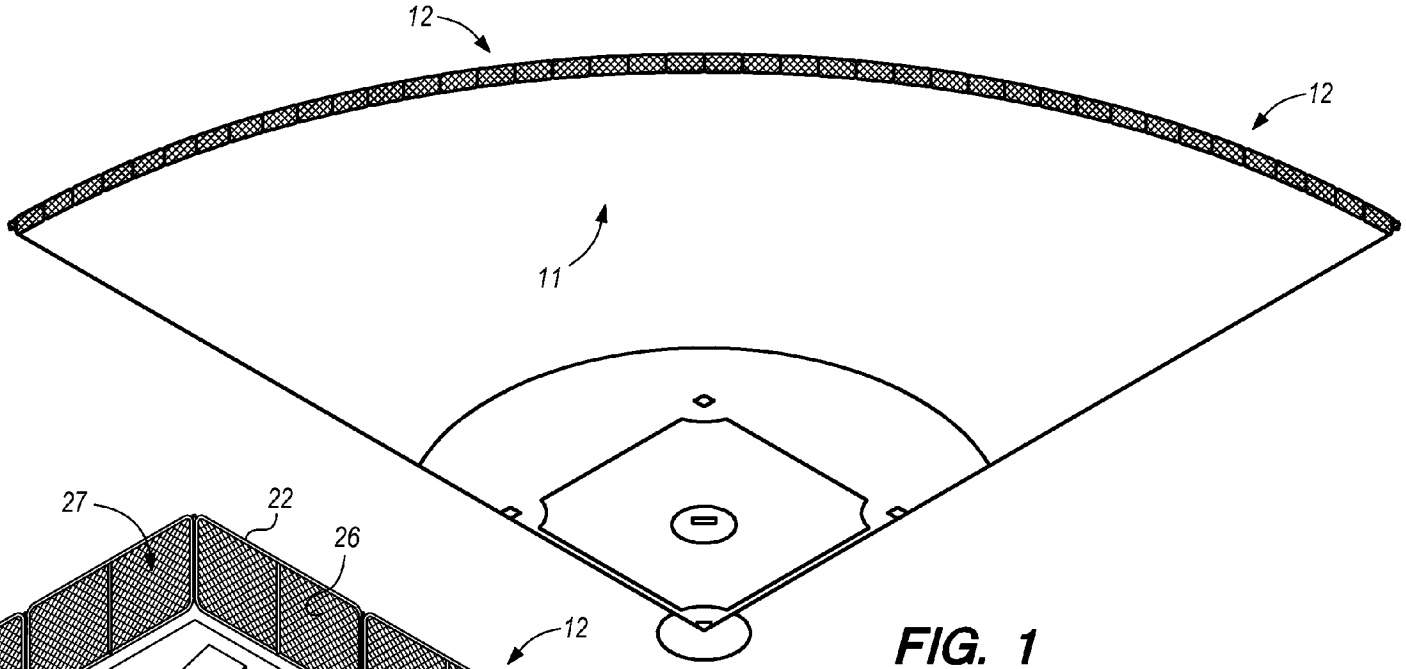
FIG. 1 is a perspective view of a baseball field, employing the portable fence system of the present invention to define the outer boundary of the outfield.

Turning now to the drawings, the portable fence system 11 disclosed herein comprises a plurality of interlocking fence units 12. Each fence unit includes a main frame 13 having an elongated rear edge 14 and opposing side edges 16. Each side edge 16 has a forward end 17 and a rearward end 18, with rearward end 18 being attached to rear edge 14. This results in a generally U-shaped main frame 13.

Alternatively, main frame 13 may be rectangular in plan, with a forward edge (not shown) interconnecting forward ends 17 of side edges 16. In this case, the forward edge would be parallel to rear edge 14 and identical in length. While this construction would provide additional strength to main frame 13, it would also increase the weight and the cost of the fence unit 12. For those reasons, it is preferred not to include a forward edge member, as it is not essential in view of the structural integrity provided by other parts of the fence unit 12, discussed below.

Main frame 13 is preferably constructed from tubular metallic material to provide a good balance between strength and weight, but other materials such as plastic, vinyl, or wood could be substituted for a specific application.

Each fence unit 12 also includes a fence member 19 with a peripheral frame 21, preferably rectangular in plan. Typical dimensions for fence member 19 would be five feet high and ten feet long, although these dimensions may be modified to suit a particular application calling for higher or longer fence units 12. The peripheral frame 21 includes a top portion 22, a bottom portion 23, and side portions 24, defining a barrier area within those portions. The bottom portion 23 of the peripheral frame 21 is pivotally affixed to the forward ends 17 of the main frame 13, by means of bracket and pin arrangements 20. The bottom portion 23 provides structural integrity both for the peripheral frame 21, and for the main frame 13 by providing a rigid member interconnecting forward ends 17 of main frame 13. It will also be appreciated that if a forward edge member were provided to main frame 13, bottom portion 23 of the peripheral frame 21 would simply be pivotally connected to that forward edge member instead of being connected to forward ends 17.

The fence member 19 preferably includes chain-link wire 26 or wire netting, within the confined barrier area of the peripheral frame 21, to form a planar physical barrier 27. Other materials or combinations of materials may be used in lieu of chain-link wire 26. For example, wooden slats may be substituted, or wooden slats may be interwoven with the chain-links, to provide more of a visual barrier in addition to a physical barrier. Arrays of plastic pipes or rods provided with a "break-away" feature for safety could also be substituted for wire 26.

Figure 3:
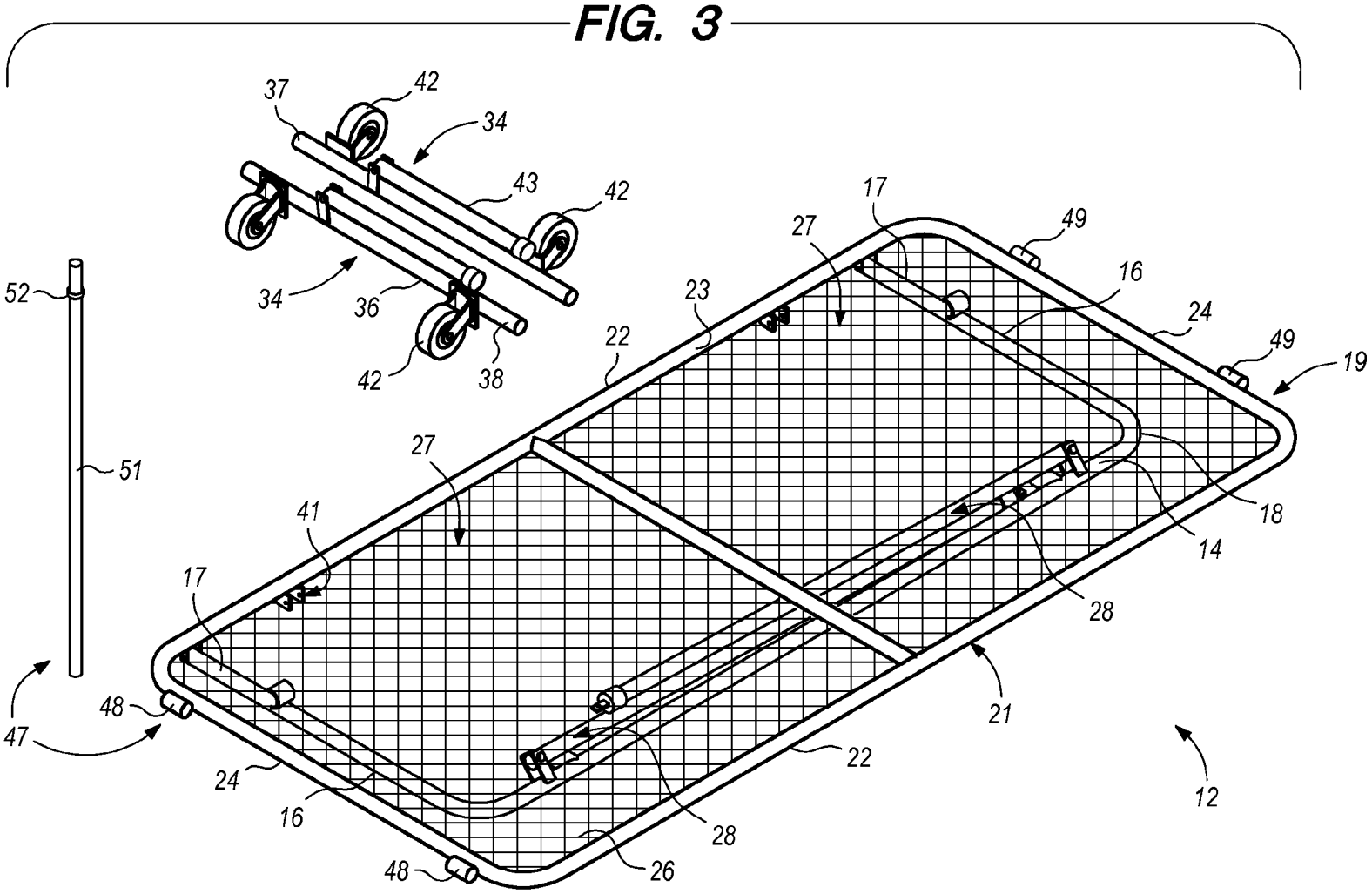
FIG. 3 is an exploded perspective view of a fence unit including the main frame and the fence member in a collapsed configuration, also showing a pair of wheel assemblies along with a locking pin or rod for interlocking fence units to each other.
Figure 14:
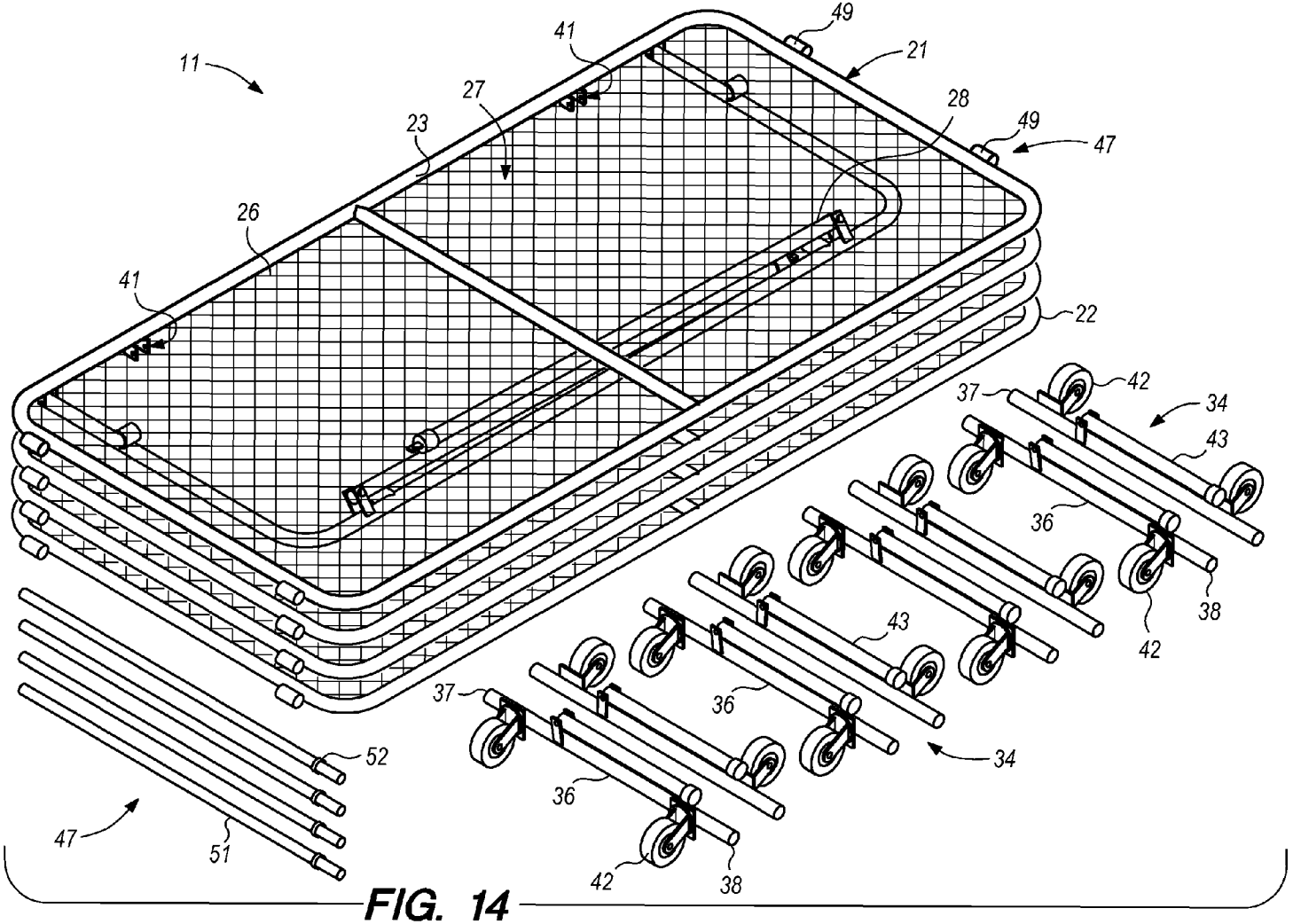

Making particular reference to FIG. 3, the fence member 19 may be rotated downwardly, about its pivotal attachment to forward ends 17, into a lowered horizontal position overlying the main frame 13. In that lowered position, the fence member 19 and the main frame 13 will present a generally planar surface for compact and stable stacking of successive fence units 12. A stacked arrangement of fence units 12, showing a plurality of fence units 12 ready for shipment or storage, is shown most clearly in FIG. 14.

Figure 4:
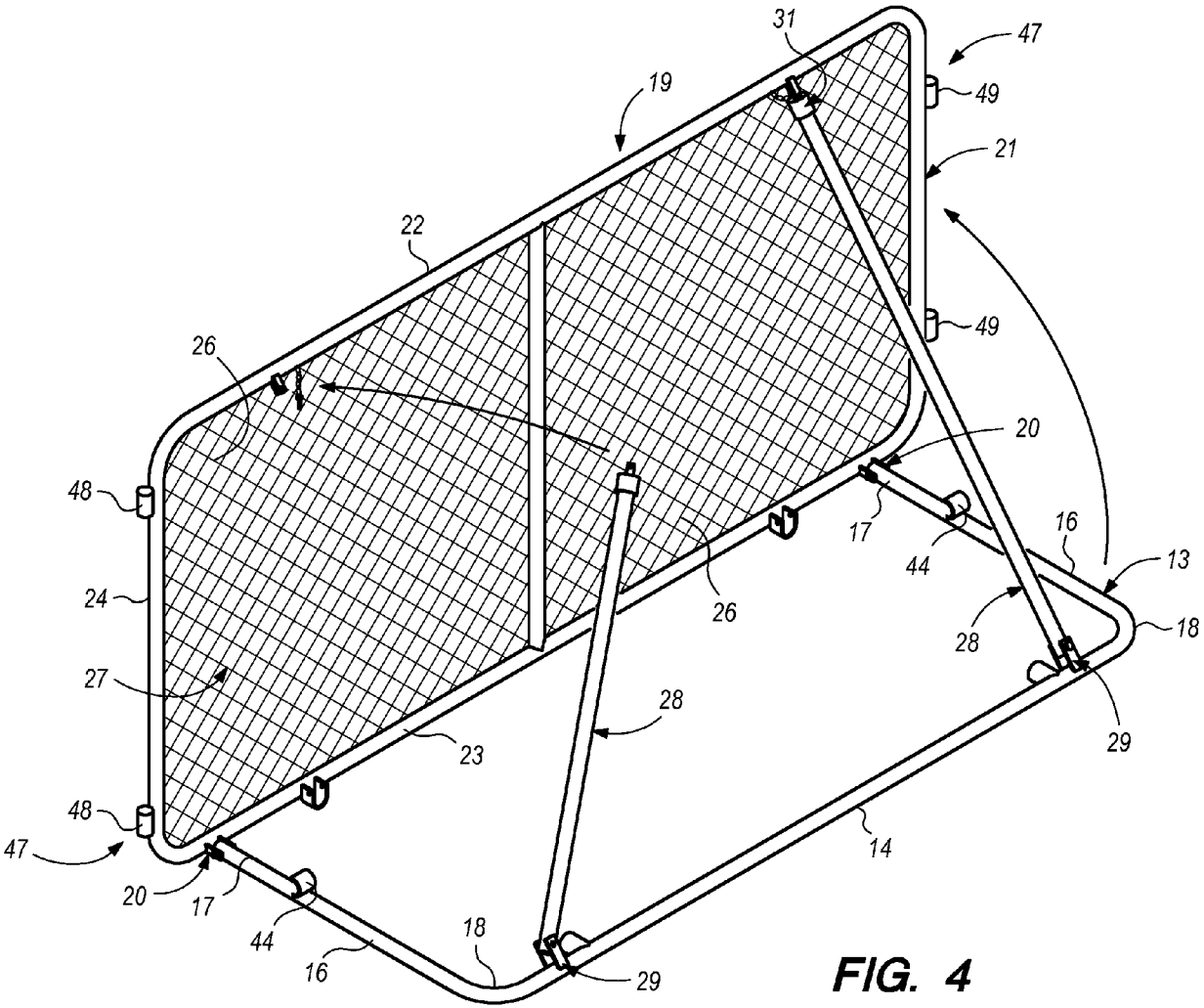
FIG. 4 is a perspective view showing the fence member being swung up into a vertical position, and the braces being swung upwardly for connection to the top portion of the fence member.
Figure 11:
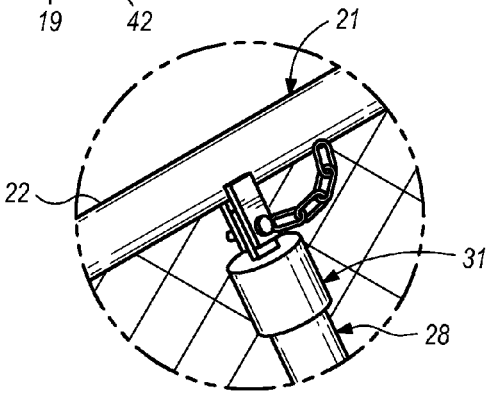
FIG. 11 is a detail inset view taken on the broken line 11 in FIG. 8, showing the clevis connector on the top portion of the fence member.

The fence member 19 may also be pivoted upwardly, into a deployed, vertical position for use. To ensure its stability and strength as a physical barrier, one or more downwardly and rearwardly inclined braces 28 extends from the top portion of the peripheral frame to the rear edge of the main frame. Braces 28 are pivotally attached by means of bracket and pin connectors 29 to the rear edge 14 of the main frame 13. This pivotal connection is made so braces 28 can be swung up into a raised position, and be selectively attached to the top portion 22 of the peripheral frame 21. (See, FIG. 4). For that purpose, clevis and pin connectors 31 are provided, to interconnect the upper free ends of braces 28 with top portion 22 to secure fence member 19. (See, FIG. 11). When so deployed, fence member 19 is supported to form a 90° angle with respect to main frame 13. (See, FIG. 7).

When fence member 19 is to be lowered, for shipment or storage, the procedure outlined above is reversed. The pivoting capabilities of braces 28 are again put to use, as braces 28 are first detached from top portion 22 and then swung downwardly into a nested position, in near parallel relation to rear edge 14, as shown in FIG. 3.

Figure 6:
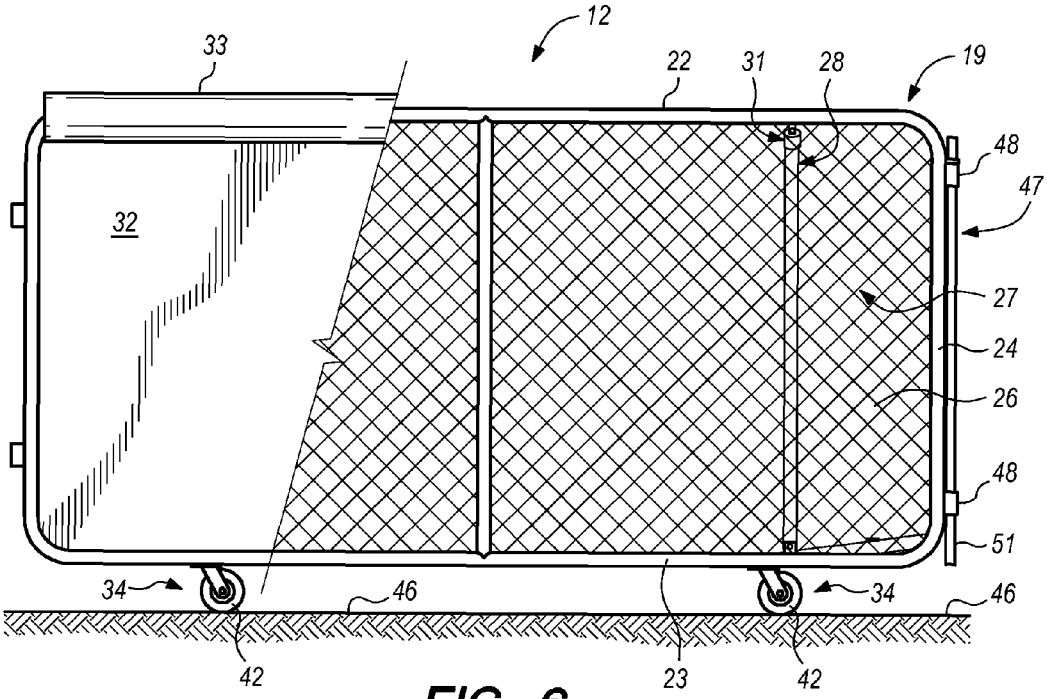
FIG. 6 is front elevational view of a fence unit with the wheel assemblies extended and deployed to space the main frame above the ground surface, fragmentary portions of sheet protective covering for the chain-link and a cylindrical tube protective covering for the top portion of the fence member being shown.

Protective coverings may be placed on portions of the fence member 19 to prevent injuries from impacting its structure. As shown in FIG. 6, these coverings include sheets 32 of plastic or rubberized material over the chain-link wire 26. Sheets 32 may also serve to provide a degree of privacy from onlookers on the rear side of the fence units 12. Another form of protection is provided by cylindrically shaped padding 33, encircling top portion 22 of peripheral frame 21. This would be useful in preventing injury to a player attempting to catch a fly ball near the top of fence unit 12.

Figure 5:
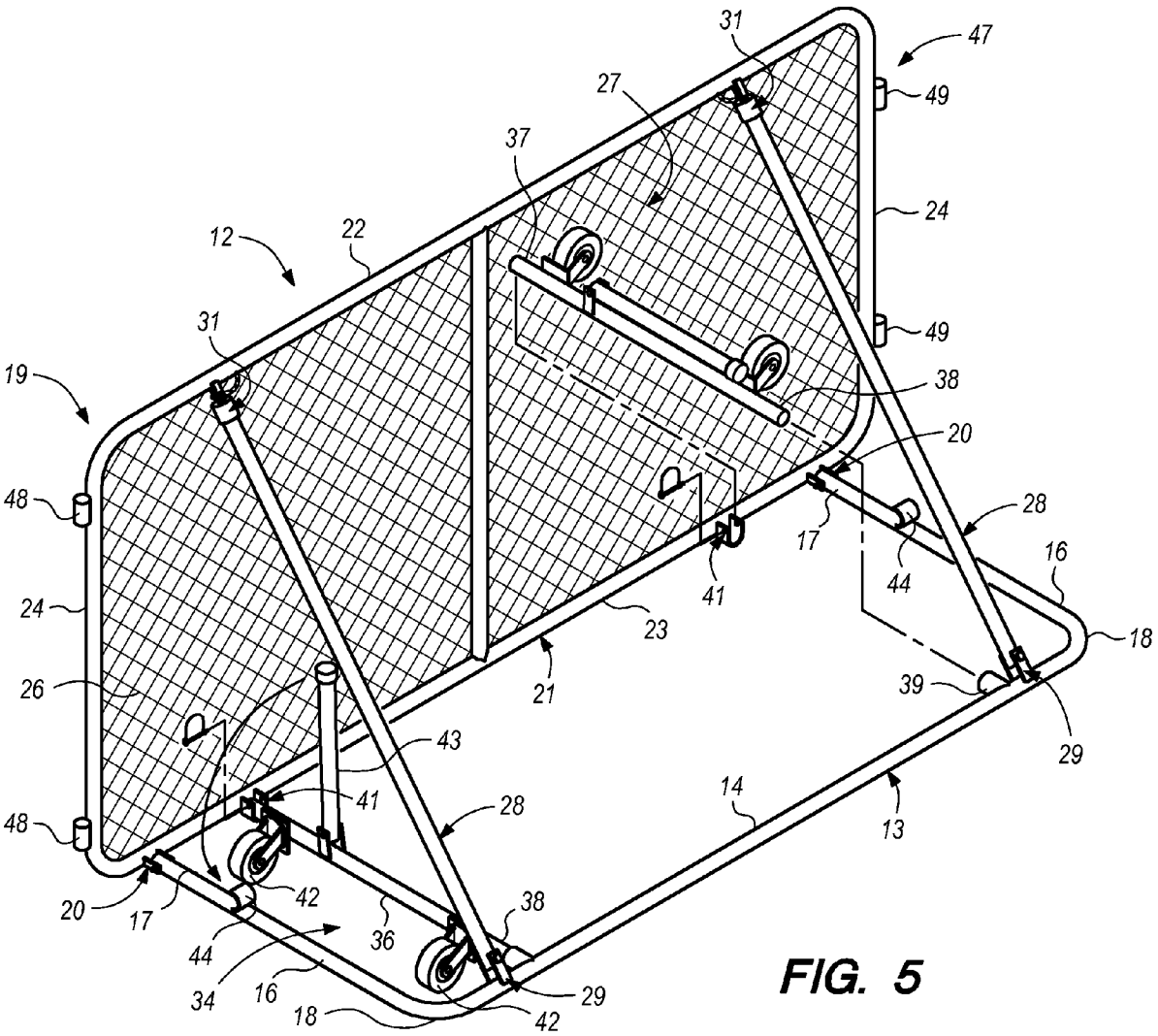
FIG. 5 is a perspective view showing a fence unit with one of the wheel assemblies installed but in a withdrawn position, and another of the wheel assemblies being installed into the detachable couplers on the bottom portion of the peripheral frame and the rear edge of the main frame.
Figure 8:
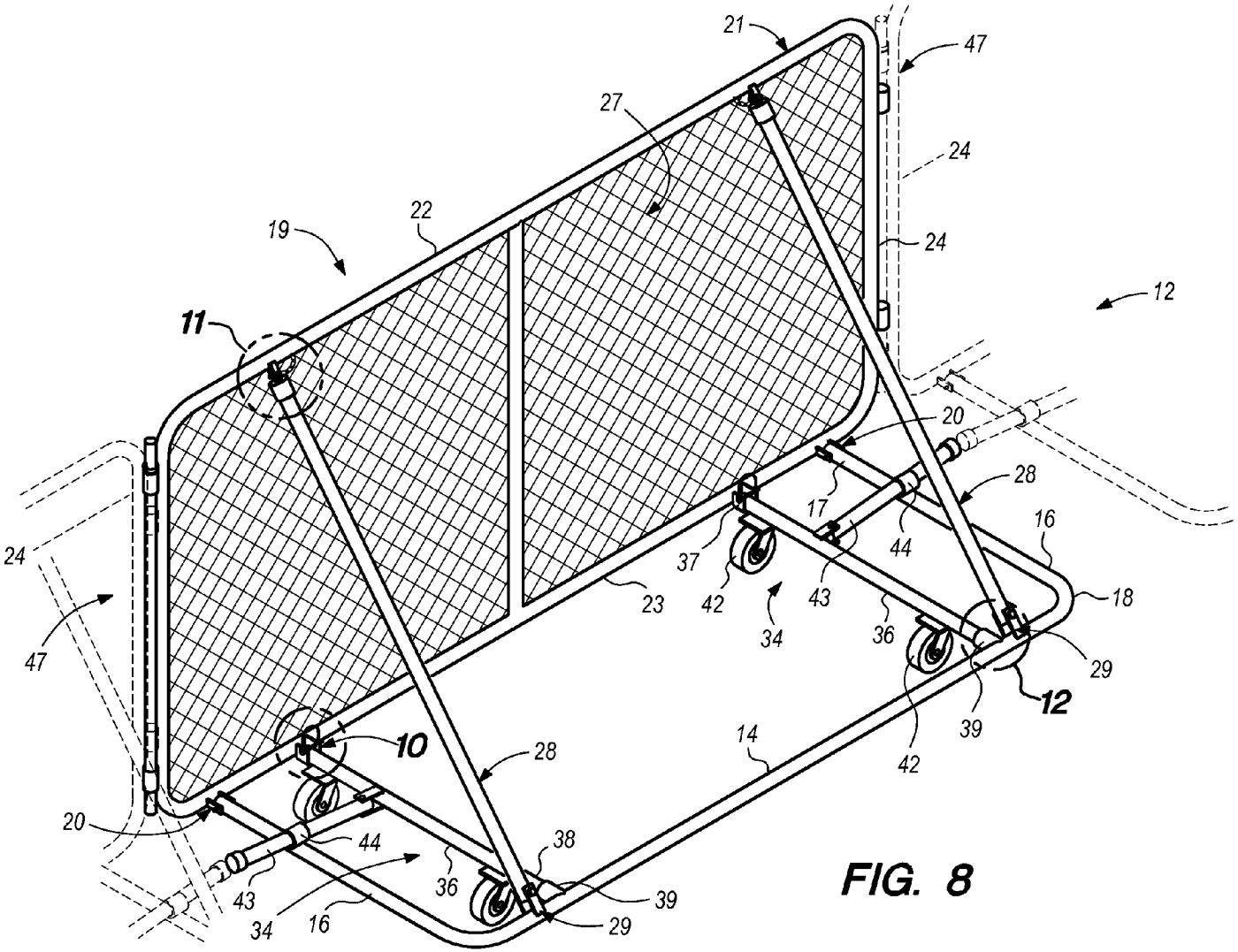
FIG. 8 is a perspective view of a fence unit fully assembled with the wheel assemblies extended and deployed, the fragmentary broken line representations of adjacent fence units being included to show how two or more fence units may be interconnected to form a continuous extended fence barrier.
Figure 10:
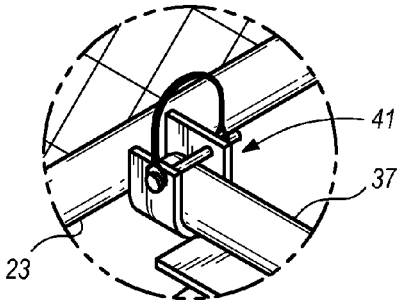
FIG. 10 is a detail inset view taken on the broken line 10 in FIG. 8, showing the detachable coupler for the wheel assembly on the bottom portion of the peripheral frame.
Figure 12:
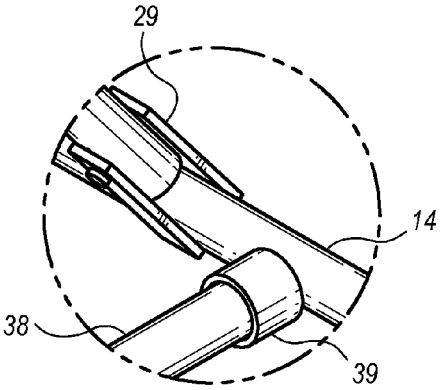
FIG. 12 is a detail inset view taken on the broken line 12 in FIG. 8, showing the detachable coupler for the wheel assembly on the rear edge of the main frame.
Figure 13:
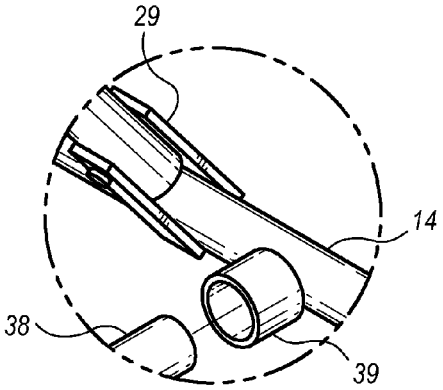
FIG. 13 is a view as in FIG. 12, but showing the manner in which the rotatable pipe of the wheel assembly couples with the detachable coupler; and, FIG. 14 is an exploded perspective view of a plurality of fence units folded down and arranged in stacked relation for transportation or storage, the respective wheel assemblies and locking pins being shown removed from the fence units.

Spanning the rear edge 14 of the main frame 13 and the bottom portion 23 of the peripheral frame 21, is at least one wheel assembly 34. (See, FIG. 8). Each wheel assembly 34 includes a support tube 36, having a front end 37 and a rear end 38. Support tube 36 is rotatably and removably secured at its front end 37 to the peripheral frame 21 and at its rear end 38 to the main frame 13, through the use of detachable coupling means. In order of assembly, rear end 38 is first inserted into cylindrical receiver 39, as shown most clearly in FIGS. 5, 12, and 13. As this process is taking place, the front end 37 of support tube 36 is lowered into the saddle and pin receiver 41. (See, FIG. 10). The open upper end of the saddle component allows tube 36 to be lowered into the saddle. The locking pin secures the front end 37 in place.

It should again be noted that both cylindrical receiver 39 and saddle and pin receiver 41 provide detachable coupling for wheel assembly 34 while allowing free rotation of support tube 36 after it has been installed in fence unit 12. This detachable coupling feature also facilitates removal of the entire wheel assembly 34 from the main frame 13, in the event that a plurality of main frames 13 needs to be stacked together for storage.

Attached in spaced relation to the support tube 36 is a pair of wheels 42. Wheels 42 are spaced a sufficient distance from each other along tube 36, to provide stability for wheel assembly 34 and fence unit 12. By providing a pair of wheel assemblies 34, one adjacent each of the side edges 16, the stability of fence unit 12 is further enhanced. When in a normal operating position, engaging the ground, wheels 42 are supported for rotation both about a horizontal axis and about a vertical axis, in a manner like most casters. Such rotational capabilities for wheels 42 allow fence unit 12 to be rolled into a selected location, by pushing or pulling.

Pivotally attached to the support tube 36 is an arm 43, which when pivoted into a position perpendicular to the support tube 36, can readily be swung to rotate the support tube 36 and the attached wheels 42 into the desired rotational position. (See, FIG. 5).

The wheel assembly 34 may be rotated into a first withdrawn position. In this position, the wheels 42 are rotated so they lie above the underside of the main frame 13. This position may be used for storage of fence units 12, allowing horizontal stacking of a plurality of the units 12 into a relatively compact stack. In other words, the fence units 12 can be stacked without having to remove each wheel assembly 34.

Figure 7:
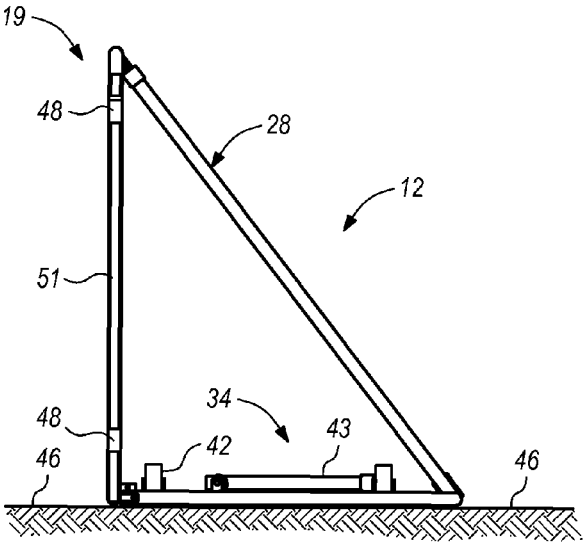
FIG. 7 is a side elevational view of a fence unit, with the wheel assemblies being shown in a withdrawn position and the main frame resting on the ground surface for stability.

This position is also useful in allowing the underside of the main frame to lie flat on the ground. This is shown in FIG. 7, where a fence unit 12 has been moved into a selected position, and it has been lowered so that the underside of the main frame 13 engages the ground surface 46. This provides a stable and secure means for placement for the fence unit 12, until the time comes to relocate or reconfigure the fence system 11.

The wheel assembly 34 may also be rotated 90°, or so, into a second extended position, to facilitate rolling transport of each fence unit 12. For example, in FIG. 5, the arm 43 of the wheel assembly 34 on the left hand side of the Figure, is rotated counter-clockwise, until the wheels engage the ground and lift the main frame 13. It is apparent in FIG. 8, that the arm 43 of the wheel assembly 34 on the right-hand side of this Figure must be rotated clockwise, to accomplish the same wheel extension. With the wheel assembly in this deployed position, the main frame 13 is supported in spaced relation from the ground surface 46, with sufficient clearance therefrom that the fence unit 12 may be rolled into a selected location. (See, FIG. 6).

For the purpose of retaining the ends of arms 43 in place after the wheel assemblies 34 have been rotated into this second extended position, arcuate clips 44 are provided, for securing each of the arms 43 to a respective side edge 16 of main frame 13.

After the fence unit 12 has been rolled into its final position, each of the wheel assemblies 34 may be rotated back to the first withdrawn position, lowering the underside of the main frame 13 of the fence unit 12 onto the ground surface 46 for stable support. In the event that the fence unit 12 has been removed from service and has been moved to a storage facility, this same process would be employed.

Figure 2:
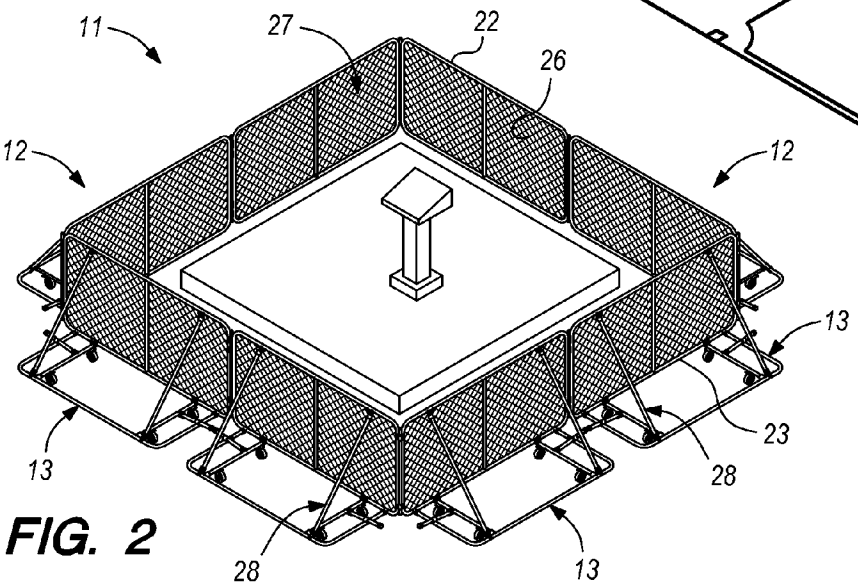
FIG. 2 is a perspective view of the portable fence system configured to surround a speaking dais, for security.

However, it should be noted that the wheel assemblies 34 may be left in their deployed position, after the fence units 12 have been rolled into their final position. This is illustrated in FIG. 2.

Coupling means 47 are provided along opposing vertical side portions 24 of the peripheral frame 21, so that adjacent fence units 12 may be pivotally interconnected to each other to provide the selected length and configuration for the fence system 11. Coupling means 47 includes a first pair of collars 48 and a second pair of collars 49. Collars 48 and collars 49 are vertically offset and mounted on opposing side portions 24 of the peripheral frame 21. It should be noted that the first pair of collars 48 are spaced farther apart than the second pair of collars 49, so there will not be mechanical interference between the two when adjacent fence units 12 are coupled.

Figure 9:
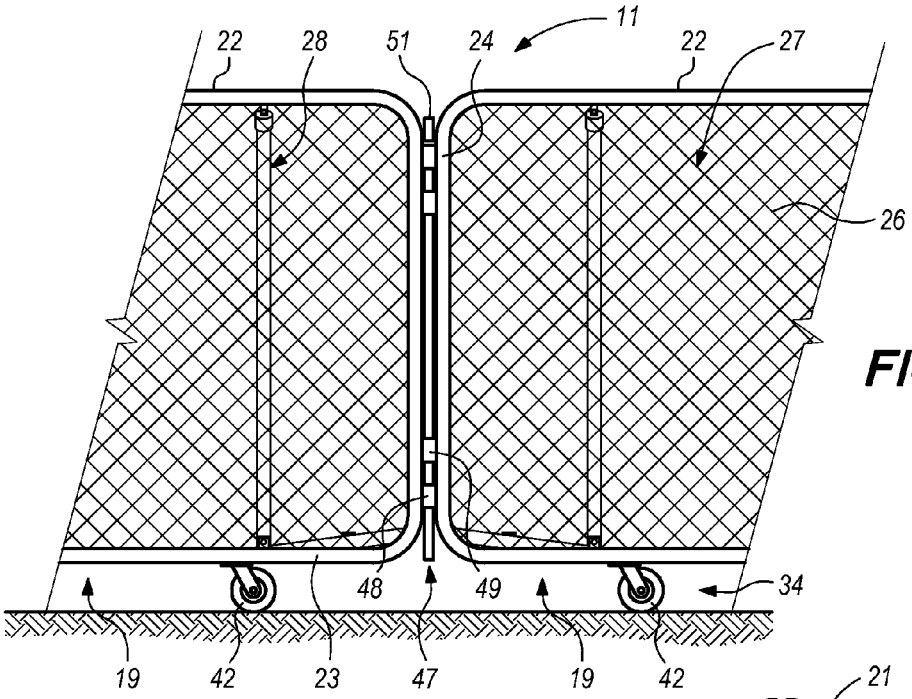
FIG. 9 is a fragmentary, front elevational view of two interconnected fence units with their wheel assemblies deployed, ready for towing to a new location.

For the purpose of interconnecting these adjacent pairs of collars 48 and 49, a link pin 51 with a shoulder 52 is provided. (See, FIG. 14). Pin 51 registers and slides within adjacent pairs of collars 48 and 49, and shoulder 52 rests upon the upper edge of an upper collar 49 to ensure that link pin 51 does not drop out of the collars 48 and 49. (See, FIG. 9).

Coupling means 47 has proven very versatile in allowing the movement of a plurality of interconnected fence units 12 together, for example, using a tow vehicle. Large numbers of fence units 12 can be preassembled at one location, deploying the fence member 19 and the wheel assemblies 34. Then, the fence units 12 can be rolled and joined together into a line, using coupling means 47. Lastly, a tow vehicle is interconnected to a lead fence unit 12, and the entire line of fence units 12 can be towed together into the proper location. Such an approach can be used advantageously, in assembling the fence units 12, shown in FIG. 1. Similarly, a group of fence units 12 can be towed to a selected location, and then rolled into the proper configuration and interconnected. This is shown in FIG. 2, where the configuration happens to be a square. Other geometric shapes, closed or open, can likewise be configured easily, using this assembly and transport method. After use of the fence units 12 in preparation for storage, or when re-arranging the fence units 12 to create a new shape, size, or type of sporting field or a security barrier, the assemblage of fence units 12 can more easily and quickly be transported and manipulated when so connected as a group.

It will be appreciated then, that we have disclosed a portable fence system 11 which expands the versatility of new and existing sports fields by providing a means to reconfigure the playing field for different sports, providing a multi-use facility. It will also be appreciated that we have disclosed a portable fence system 11 herein which may also be used for other fence and barrier applications for security, animal confinement, and crowd control.

What is claimed is:

1. A fence unit comprising:

a. a main frame, said main frame having a rear edge and opposing side edges, each side edge having a forward end and a rearward end, said rearward end being attached to said rear edge;

b. a fence member including a peripheral frame, said peripheral frame having a top portion, a bottom portion, and side portions defining a barrier area, said bottom portion being pivotally attached to said main frame, said fence member including a planar barrier within said barrier area;

c. at least one downwardly and rearwardly inclined brace extending from said top portion of said peripheral frame to said rear edge of said main frame;

d. at least one wheel assembly, said wheel assembly comprising a support tube having a front end and a rear end, said front end and said rear end being rotatably and removably secured, respectively, to said bottom portion of said peripheral frame and said rear edge of said main frame, said wheel assembly further including a pair of wheels attached to said support tube between said front end and said rear end, said wheel assembly further including an arm, said arm being pivotally attached to said support tube and rotatable into a position perpendicular to the support tube, for rotating said support tube and said attached wheels into a selected rotational position.

2. The fence unit of claim 1 in which said wheel assembly is rotatable into a first withdrawn position in which said wheels lie above an underside of said main frame, allowing the underside of the main frame to lie flat on a supporting surface or structure, and in which said wheel assembly is rotatable into a second extended position, in which said underside of said main frame is supported in spaced relation from the supporting surface, allowing said fence unit to be rolled thereover.

3. The fence unit of claim 2 including a pair of said wheel assemblies, one of said wheel assemblies being adjacent each side edge of said main frame.

4. The fence unit of claim 3 in which said wheels rotate about a horizontal axis, and in which said wheels are rotatably supported about a vertical axis, when said wheel assemblies are rotated into said second extended position.

5. The fence unit of claim 4 including means for securing each arm of said wheel assemblies to a respective said side edge of said main frame, when said wheel assemblies are rotated into said second extended position.

6. The fence unit of claim 1 including interconnecting means along each side portion of said peripheral frame, for serially coupling two or more said fence units together.

7. The fence unit of claim 6 in which said interconnecting means comprises a pair of coaxial collars mounted along said each side portion, said collars on both said side portions being arranged in spaced relation, and said collars on one of said side portions being vertically offset with respect to said collars on the other side portion of said peripheral frame, and in which said interconnecting means further comprises a locking pin or rod, sized and configured to slide within said collars.

8. The fence unit of claim 1 in which said planar barrier is chain-link or a netting material covered with a protective sheet on an outer side, and in which said top portion of said peripheral frame is covered with a protective cylindrical material.

9. The fence unit of claim 1 including two braces, and in which said two braces are pivotally attached to said rear edge of said main frame, and detachably connected to said top portion of said peripheral frame with a respective clevis and a respective pin.

10. A fence unit comprising:

a. a main frame, said main frame having a rear edge and opposing side edges, each side edge having a forward end and a rearward end, said rearward end being attached to said rear edge;

b. a fence member including a peripheral frame, said peripheral frame having a top portion, a bottom portion, and side portions defining a barrier area, said bottom portion being pivotally attached to said forward ends of said side edges, said fence member including a planar barrier within said barrier area;

c. a pair of downwardly and rearwardly inclined braces extending from said top portion of said peripheral frame to said rear edge of said main frame;

d. a pair of wheel assemblies, each of said wheel assemblies comprising a support tube having a front end and a rear end, said front end and said rear end being rotatably and removably secured, respectively, to said bottom portion of said peripheral frame and said rear edge of said main frame, adjacent each side edge of said main frame, each of said wheel assemblies further including a pair of wheels attached to said support tube between said front end and said rear end, each of said wheel assemblies further including an arm, said arm being pivotally attached to said support tube and rotatable into a position perpendicular to the support tube, for rotating said support tube and said attached wheels into a first withdrawn position in which said wheels lie above an underside of said main frame, allowing the underside of the main frame to lie flat on a supporting surface or structure, and in which each of said wheel assemblies is rotatable into a second extended position, in which said underside of said main frame is supported in spaced relation from the supporting surface, allowing said fence unit to be rolled thereover.

11. The fence unit of claim 10 in which said wheels rotate about a horizontal axis, and in which said wheels are rotatably supported about a vertical axis, when said wheel assemblies are rotated into said second extended position.

12. The fence unit of claim 10 including means for securing each of said arms to a respective said side edge of said main frame, when said wheel assemblies are rotated into said second extended position.

13. The fence unit of claim 10 including interconnecting means along each side portion of said peripheral frame, for serially coupling two or more said fence units together.

14. A fence system comprising at least two fence units each of said fence units comprising: a main frame, said main frame having a rear edge and opposing side edges, each side edge having a forward end and a rearward end, said rearward end being attached to said rear edge; a fence member including a peripheral frame, said peripheral frame having a top portion, a bottom portion, and side portions defining a barrier area, said bottom portion being pivotally attached to said forward ends of said side edges of said main frame, said fence member including a planar barrier within said barrier area; at least one downwardly and rearwardly inclined brace extending from said top portion of said peripheral frame to said rear edge of said main frame; at least one wheel assembly, said wheel assembly comprising a support tube having a front end and a rear end, said front end and said rear end being rotatably and removably secured, respectively, to said bottom portion of said peripheral frame and said rear edge of said main frame, said wheel assembly further including a pair of wheels attached to said support tube between said front end and said rear end, said wheel assembly further including an arm, said arm being pivotally attached to said support tube and rotatable into a position perpendicular to said support tube, for rotating said support tube and said attached wheels into a first withdrawn position in which said wheels lie above an underside of said main frame, allowing the underside of the main frame to lie flat on a supporting surface or structure, and in which said wheel assembly is rotatable into a second extended position, in which said underside of said main frame is supported in spaced relation from the supporting, allowing said fence unit to be rolled thereover; and interconnecting means along each side portion of said peripheral frame, for serially coupling said at least two fence units together.

15. The fence system of claim 14, in which said at least two fence units are arranged either in a linear fashion, or in an arcuate fashion, or in a geometric shape.

16. The fence system of claim 14 in which said at least two fence units are arranged in an arcuate fashion, to define an outfield fence, for a baseball field.

17. The fence system of claim 14 in which said at least two fence units are arranged in a geometric shape to surround a performing stage or a speaking platform.

18. The fence system of claim 14 in which said wheels rotate about a horizontal axis, and in which said wheels are rotatably supported about a vertical axis, when said wheel assemblies are rotated into said second extended position.

19. The fence system of claim 14 including means for securing said arm to one of said side edges of said main frame, when said wheel assembly is rotated into said second extended position.

20. The fence system of claim 14 in which said interconnecting means comprises a pair of coaxial collars mounted along said each side portion, said collars on both said side portions being arranged in spaced relation, and said collars on one said side portion being vertically offset with respect to said collars on the other side portion of said peripheral frame, and in which said interconnecting means further comprises a locking pin or rod, sized and configured to slide within said collars.

* * * * *